US009248986B2

(12) United States Patent
Aoki

(10) Patent No.: US 9,248,986 B2
(45) Date of Patent: Feb. 2, 2016

(54) SHEET FEEDING DEVICE AND IMAGE RECORDING APPARATUS

(71) Applicant: BROTHER KOGYO KABUSHIKI KAISHA, Nagoya-shi, Aichi-ken (JP)

(72) Inventor: Hirotaka Aoki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/278,509

(22) Filed: May 15, 2014

(65) Prior Publication Data

US 2014/0339757 A1 Nov. 20, 2014

(30) Foreign Application Priority Data

May 17, 2013 (JP) ..... 2013-104862

(51) Int. Cl.

| | |
|---|---|
| ***B65H 3/06*** | (2006.01) |
| ***B65H 5/26*** | (2006.01) |
| ***B65H 1/04*** | (2006.01) |
| ***B65H 9/00*** | (2006.01) |
| ***B65H 3/52*** | (2006.01) |
| ***B65H 1/26*** | (2006.01) |
| ***B65H 3/56*** | (2006.01) |
| ***B65H 3/66*** | (2006.01) |
| ***B65H 5/38*** | (2006.01) |

(52) U.S. Cl.

CPC .. *B65H 5/26* (2013.01); *B65H 1/04* (2013.01); *B65H 1/266* (2013.01); *B65H 3/06* (2013.01); *B65H 3/0684* (2013.01); *B65H 3/5223* (2013.01); *B65H 3/56* (2013.01); *B65H 3/66* (2013.01); *B65H 5/38* (2013.01); *B65H 9/00* (2013.01); *B65H 2402/441* (2013.01); *B65H 2404/54* (2013.01); *B65H 2404/6111* (2013.01); *B65H 2405/1136* (2013.01); *B65H 2405/3321* (2013.01); *B65H 2801/12* (2013.01)

(58) Field of Classification Search

CPC ..... B65H 3/06; B65H 3/5223; B65H 2405/1136; B65H 3/0684; B65H 2404/6111

USPC ..... 271/121, 145, 162, 167, 264, 272, 271/10.01, 10.09, 10.11

See application file for complete search history.

(56) References Cited

U.S. PATENT DOCUMENTS

| | | | | |
|---|---|---|---|---|
| 8,141,866 | B2 | 3/2012 | Okawa et al. | |
| 2008/0290585 | A1 | 11/2008 | Asada | |
| 2013/0256975 | A1 * | 10/2013 | Tsutsui et al. | 271/10.01 |

FOREIGN PATENT DOCUMENTS

| | | | |
|---|---|---|---|
| JP | 2008-290860 | A | 12/2008 |
| JP | 2010222120 | A | 10/2010 |

* cited by examiner

*Primary Examiner* — David H Bollinger

(74) *Attorney, Agent, or Firm* — Scully, Scott, Murphy & Presser, PC

(57) ABSTRACT

A sheet feeding device comprising a tray, a sheet feeder, first and second guide members, a separator, and an inclined guide portion. The first guide member disposed downstream of the tray and includes a first inclined surface that contacts and guides the sheets. The separator separates the sheets from other lower sheets. The second guide member is disposed downstream of the first guide member and includes a second inclined surface that contacts the sheets. The second inclined surface is inclined more steeply than the first inclined surface relative to a supporting surface of the tray. A first inclined guide portion extends from an upper end portion of the first guide member and includes a third inclined surface that contacts the sheets. The third inclined surface is inclined more steeply than the first inclined surface.

15 Claims, 10 Drawing Sheets

SHEET FEEDING DEVICE AND IMAGE RECORDING APPARATUS

CROSS REFERENCE TO RELATED APPLICATION

This application claims priority from Japanese Patent Application No. 2013-104862, filed on May 17, 2013, the entire disclosure of which is incorporated herein by reference.

BACKGROUND OF THE INVENTION

1. Field of the Invention

The present invention relates to a sheet feeding device and an image recording apparatus comprising a sheet feeding apparatus.

2. Description of Related Art

A known sheet feeding device comprises a tray for holding sheets thereon and is configured to feed a sheet from the tray to an inkjet or electrophotographic image recording apparatus with the tray attached thereto.

In the known image recording apparatus, the tray is disposed at the bottom of the apparatus, and the feeding or conveying direction of a sheet fed from the tray needs to be changed because of a limited inner space of the apparatus. Specifically, the sheet fed substantially horizontally from the tray at the bottom is directed upward toward an upper portion of the apparatus.

It may be beneficial for a sheet feeding device to be configured to feed a sheet from a tray smoothly regardless of the amount of sheets stacked on the tray while changing the feeding or conveying direction of the sheet to an upward direction.

SUMMARY OF THE INVENTION

According to an embodiment of the invention, a sheet feeding device comprises a tray, a sheet feeder, first and second guide members, a separator, and an inclined guide portion. The tray comprises a supporting surface configured to support a stack of sheets and has opposite ends in a width direction. The width direction is perpendicular to a feeding direction and parallel to the supporting surface. The sheet feeder is configured to feed a sheet uppermost in the stack in the feeding direction. The first guide member is disposed downstream of the tray in the feeding direction, the first guide member comprising a first inclined surface configured to contact the sheet fed by the sheet feeder and guide the sheet in a conveying direction. The first inclined surface is inclined relative to the supporting surface such that a downstream end of the first inclined surface is above an upstream end in the feeding direction. The separator is configured to separate the sheet fed by the sheet feeder from other lower sheets. The second guide member is disposed downstream of the first guide member in the conveying direction. The second guide member comprises a second inclined surface configured to contact the sheet fed by the sheet feeder. The second inclined surface is inclined more steeply than the first inclined surface relative to the supporting surface. The first inclined guide portion extends downstream in the conveying direction from an upper end portion of the first guide member. The first inclined guide portion comprises a third inclined surface configured to contact the sheet fed by the sheet feeder. The third inclined surface is inclined more steeply than the first inclined surface relative to the supporting surface and is positioned in a range from one of the opposite ends of the supporting surface in the width direction to a midpoint between the separator and the one of the opposite ends of the supporting surface.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Figure 1:
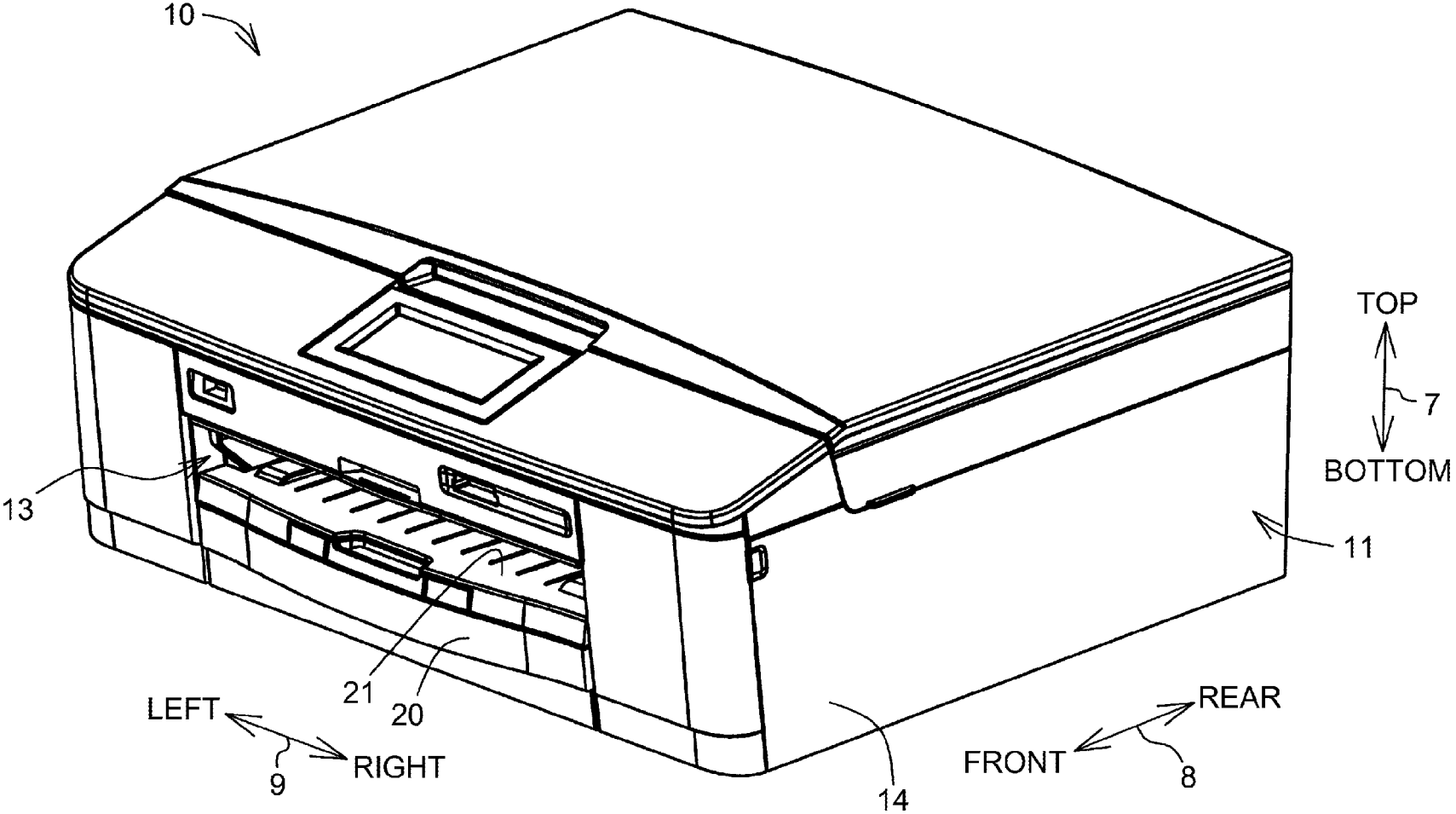
FIG. 1 is a perspective view of a multi-function device, according to an embodiment of the invention.

Embodiments of the invention and their features and technical advantages may be understood by referring to FIGS. 1-10, like numerals being used for like corresponding parts in the various drawings.

In the following description, a top-bottom direction 7 is defined when a multi-function device 10 is disposed in an orientation (shown in FIG. 1) in which the multi-function device 10 is intended to be used, and a front-rear direction 8 is defined such that a side having an opening 13 is positioned on the front side (at the front), and a left-right direction 9 is defined when the multi-function device 10 is viewed from the front side.

[General Structure of Multi-Function Device 10]

As shown in FIG. 1, the multi-function device 10 (an example of an image recording apparatus) comprises an inkjet printer 11 and has various functions including a facsimile function and a printing function.

The printer 11 comprises a housing 14 having a substantially rectangular parallelepiped shape. The housing 14 has an opening 13 on the front side. A feed tray 20 (an example of a support member) and a discharge tray 21 are insertable into and withdrawable from the housing 14 through the opening 13. The feed tray 20 may be removed completely from the housing 14 or may be pulled out halfway from the housing 14. Recording sheets 12 (an example of a sheet) of desired sizes, e.g. A4 and B5, are placed in stack on the feed tray 20.

Figure 2:
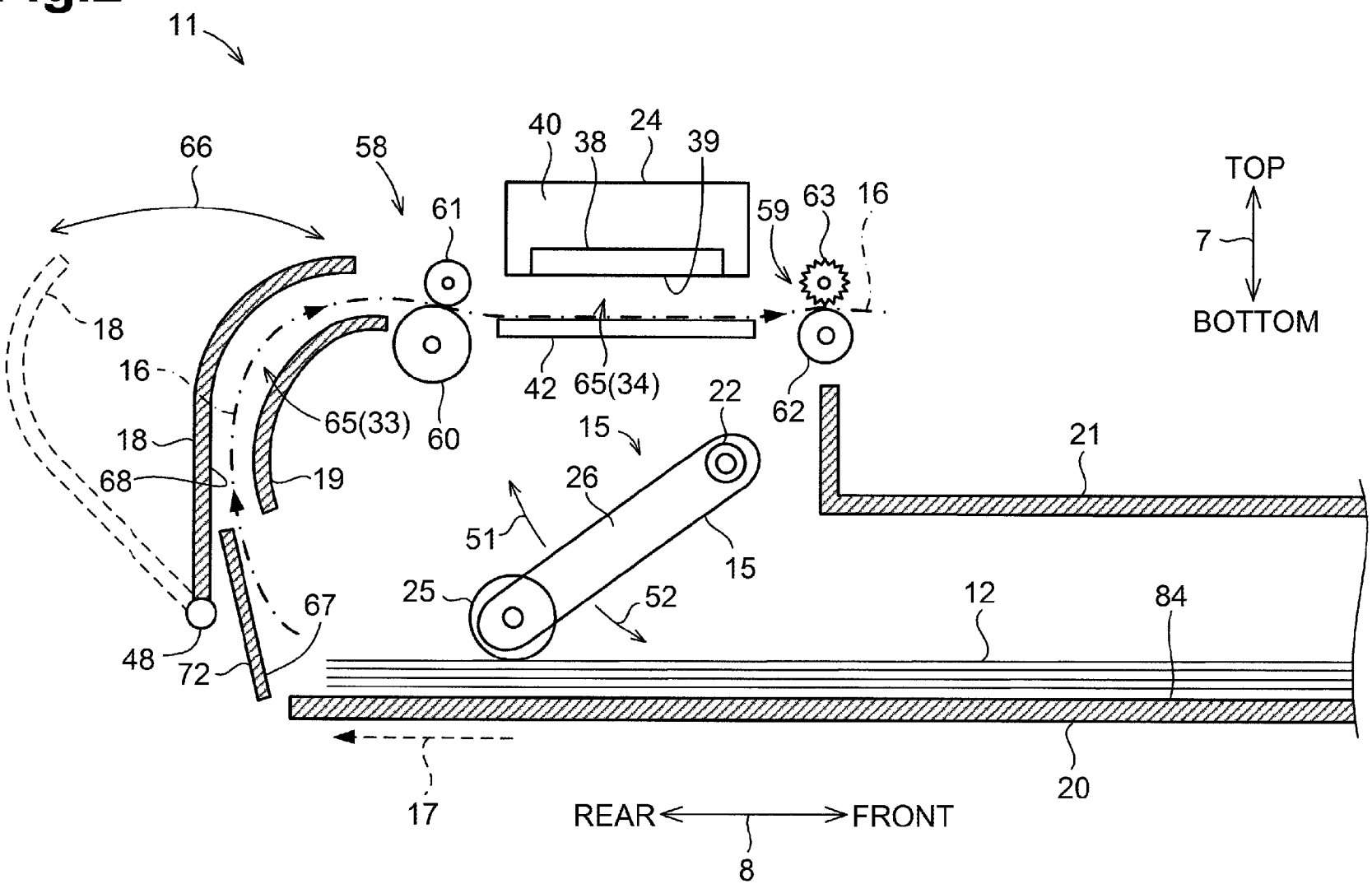
FIG. 2 is a vertical sectional view of a printer of the multi-function device of FIG. 1, schematically showing an internal structure of the printer.

As shown in FIG. 2, the printer 11 comprises a convey roller pair 58 and a discharge roller pair 59 for conveying a recording sheet 12, an inkjet recording unit 24 for recording an image on the recording sheet 12, and a sheet feed device. The recording unit 24 may be of the electrophotographic type instead of the inkjet type.

The sheet feed device comprises the feed tray 20, a sheet feeder 15, a guide member 72 (an example of a first guide member), and an outer guide member 18 (an example of a second guide member). The sheet feeder 15 feeds a recording sheet 12 from the feed tray 20 in a feeding direction 17 (rearward). The guide member 72 contacts the recording sheet 12 fed by the sheet feeder 15 in the feeding direction 17 and guides the recording sheet 12 in a conveying direction 16 (obliquely upward and rearward). The outer guide member 18 partially defines a conveying path 65 and contacts the recording sheet 12 having passed the guide member 72 and guides the recording sheet 12 in the conveying direction 16 (substantially vertically upward). The conveying direction 16 is a direction along the conveying path 65, as shown by a one-dot-one-dash arrowed line in FIG. 2. The conveying direction 16 varies depending on the location of the recording sheet 12 in the conveying path 65. As described above, the conveying direction 16 in which the guide member 72 guides the recording sheet 12 is an obliquely upward and rearward direction, and the conveying direction 16 in which the outer guide member 18 guides the recording sheet 12 is a substantially vertically upward direction.

The conveying path 65 is defined to extend from a rear end of the feed tray 20. A curved portion 33 and a straight portion 34 are defined along the conveying path 65. The curved portion 33 is defined by an outer guide member 18 and an inner guide member 19 which face each other while leaving a predetermined space therebetween. Each of the outer guide member 18 and the inner guide member 19 extends in the left-right direction 9, which is a direction perpendicular to the drawing sheet plane of FIG. 2. The outer guide member 18 is disposed behind the inner guide member 19 in a front to rear direction. The straight portion 34 extends in the front-rear direction 8 and is defined by the recording unit 24 and the platen 42 which face each other while leaving a predetermined space therebetween.

The outer guide member 18 is configured to pivot in arrowed directions 66 about a shaft 48 at the bottom. The outer guide member 18 at a position shown by a solid line in FIG. 2 defines the curved portion 33 from an outer side. The outer guide member 18 at a position shown by a broken line in FIG. 2 exposes the curved portion 33 to the outside. The user of the multi-function device 10 is allowed to remove a recording sheet 12 jammed in the curved portion 33 by pivoting the outer guide member 18 to the position shown by the broken line in FIG. 2. The state of the outer guide member 18 may be changed other than by pivoting the outer guide member 18. For example, the outer guide member 18 may be detachably attached to the printer 11.

The recording sheet 12 fed by the sheet feeder 15 in the feeding direction 17 contacts the guide member 72, which directs the recording sheet 12 from the feeding direction 17 to an obliquely upward and rearward direction (the conveying direction 16). Then the sheet feeder 15 and the convey roller pair 58 convey the recording sheet 12 in the conveying direction 16. At this time, the outer guide member 18 and the inner guide member 19 guide the recording sheet 12 along the conveying path 65 while changing the conveying direction 16 from the obliquely upward and rearward direction to a substantially vertically upward direction. When the recording sheet 12 passes the curved portion 33 and reaches the straight portion 34, the conveying direction 16 of the recording sheet 12 changes from the substantially vertically upward direction to a frontward direction. The recording unit 24 records an image on the recording sheet 12 conveyed along the straight portion 34. The discharge roller pair 59 conveys the recording sheet having the image thereon frontward (in the conveying direction 16) and discharges the recording sheet 12 onto the discharge tray 21.

[Recording Unit 24]

As shown in FIG. 2, the recording unit 24 is disposed above the straight portion 34. The platen 42 for supporting the recording sheet 12 is disposed below and opposite to the recording unit 24. The recording unit 24 comprises a carriage 40 and a recording head 38.

The carriage 40 is supported by two guide rails (not shown), which are spaced from each other in the front-rear direction 8, so as to reciprocate in the left-right direction 9. The recording head 38 is mounted in the carriage 40. Ink is supplied from an ink cartridge (not shown) to the recording head 38. The recording head 38 has nozzles 39 at the bottom surface thereof. The recording head 38 ejects ink droplets from the nozzles 39 toward the platen 42 when the carriage 40 reciprocates in the left-right direction 9. Consequently, an image is recorded on the recording sheet 12 being conveyed in the conveying direction 16 and supported on the platen 42.

[Convey Roller Pair 58 and Discharge Roller Pair 59]

As shown in FIG. 2, the convey roller pair 58 is disposed upstream of the recording unit 24 in the conveying direction 16. The discharge roller pair 59 is disposed downstream of the recording unit 24 in the conveying direction 16.

The convey roller pair 58 comprises a convey roller 60 disposed below the straight portion 34 and a pinch roller 61 disposed above and opposite to the convey roller 60. The pinch roller 61 is urged toward the convey roller 60 by a coil spring (not shown) or the like. The discharge roller pair 44 comprises a discharge roller 62 disposed below the straight portion 34 and a spur 63 disposed above and opposite to the discharge roller 62. The spur 63 is urged toward the discharge roller 62 by a coil spring (not shown) or the like.

The convey roller 60 and the discharge roller 62 are driven to rotate by a feed motor (not shown). The recording sheet 12 nipped by the convey roller pair 58 and the discharge roller pair 59 are conveyed in the conveying direction 16.

[Feed Tray 20]

Figure 3:
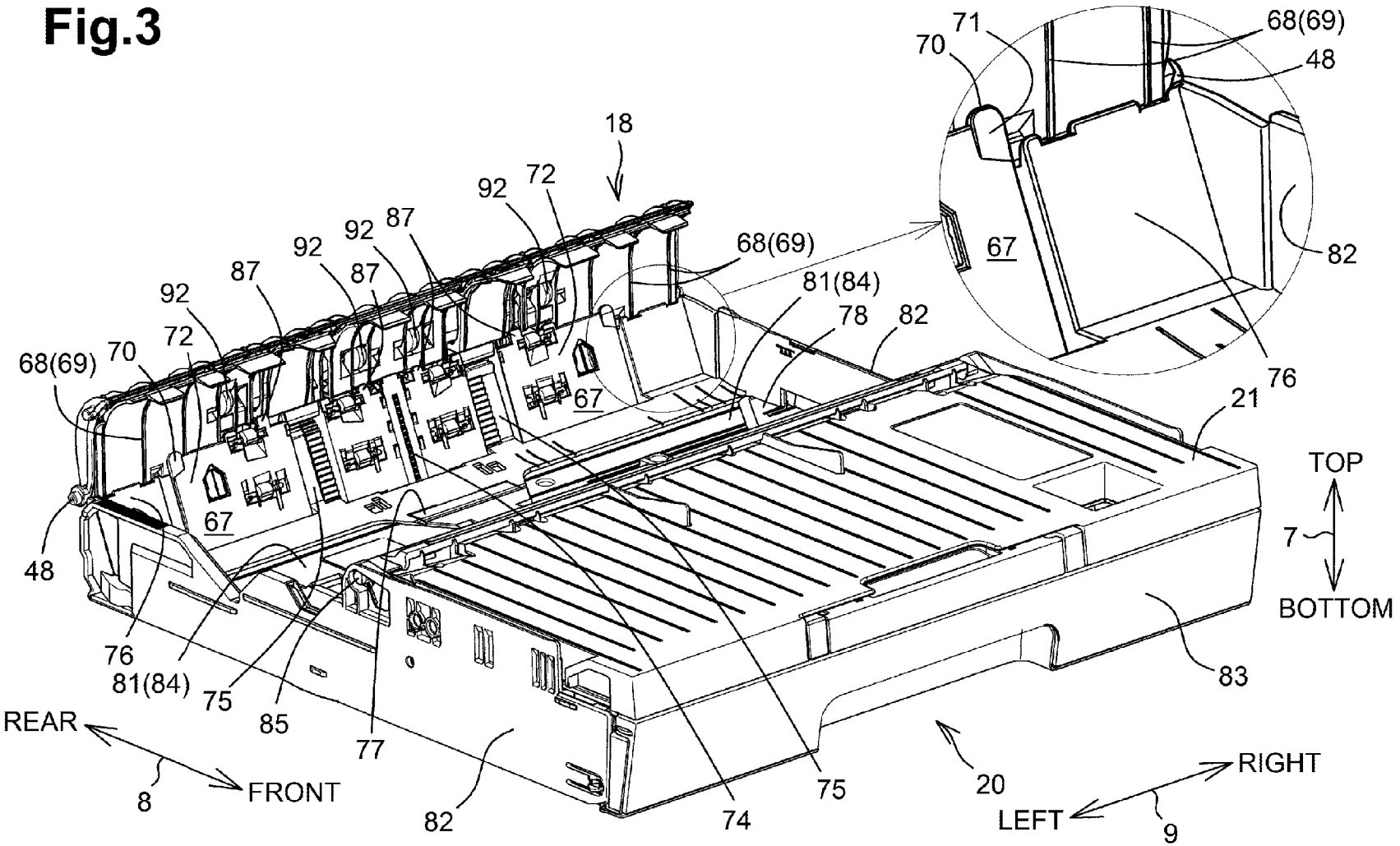
FIG. 3 is a perspective view of a feed tray, a discharge tray, a guide member, and an outer guide member when the feed tray is attached to a housing of the printer.
Figure 4:
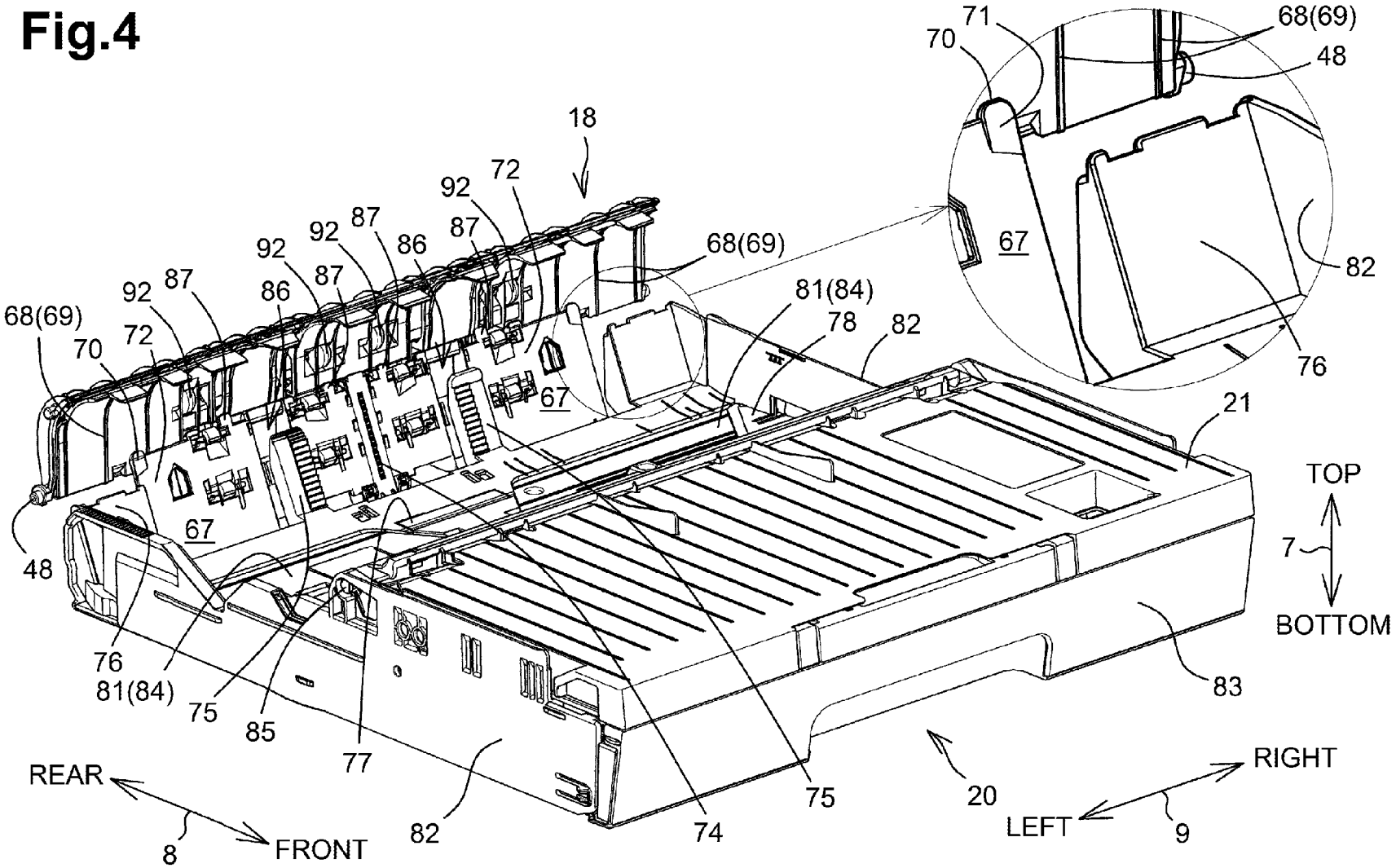
FIG. 4 is a perspective view of the feed tray, the discharge tray, the guide member, and the outer guide member when the feed tray is pulled outward, relative to the housing, from a state shown in FIG. 3.

As shown in FIGS. 3 and 4, the feed tray 20 is shaped like a box with its top open. The feed tray 20 comprises a sheet holding plate 81 for holding recording sheets 12 thereon, a pair of side plates 82, and a front plate 83. The side plates 82 stand upward from left and right ends of the sheet holding plate 81 and extend in the front-rear direction 8. The front plate 83 strands upward from the front end of the sheet holding plate 81 and extends in the left-right direction 9. The sheet holding plate 81 has a flat surface extending in the front-rear direction 8 and in the left-right direction 9. An upper surface 84 (an example of a supporting surface) of the sheet holding plate 81 holds a stack of recording sheets 12 thereon.

The sheet holding plate 81 has a recess in the upper surface 84. A friction pad 77 (shown in FIG. 5) is embedded in the recess. The friction pad 77 is made of resin or other material, e.g., cork, having a higher friction coefficient than the upper surface 84. An upper end of the friction pad 77 embedded in the recess protrudes upward beyond the upper surface 84. The friction pad 77 is disposed at a central portion in the left-right direction 9 of the sheet holding plate 81 and rearward of a central portion in the front-rear direction 8 of the sheet holding plate 81. The friction pad 77 is disposed at a position to be contacted by a feed roller 25, which will be described later.

As shown in FIGS. 3 to 5, and 7, a pair of side guides 78 movable in the left-right direction 9 and a rear guide 89 (shown in FIG. 7) movable in the front-rear direction 8 are attached to the sheet holding plate 81. The side guides 78 contact left and right edges of the recording sheets 12 held on the sheet holding plate 81, and the rear guide contacts front edges of the recording sheets 12 held on the sheet holding plate 81. When one of the side guides 78 is moved in one of right and left directions, the other of the side guides 78 moves in the other of right and left directions. The side guides 78 and the rear guide 89 allow recording sheets 12 of various sizes to be placed on the sheet holding plate 81 with reference to the center in the left-right direction 9 of the sheet holding plate 81.

Instead of the pair of side guides 78, a single side guide 87 and one of the side plates 82 may be used to position the recording sheets 12. In this case, recording sheets of various sizes may be placed with reference to the left end or the right end of the sheet holding plate 81.

The discharge tray 21 is disposed above a front portion of the feed tray 20 and is supported by the front plate 83 and the side plates 82 of the feed tray 20. The discharge tray 21 is pivotable about a shaft 85 (shown in FIGS. 3 and 4) in arrowed directions 57 (shown in FIG. 7A) so as to open and close the top of the feed tray 20. When the top of the feed tray 20 is open, the user is allowed to load and unload the recording sheets 12 to and from the feed tray 20.

The feed tray 20 is inserted from its rear through the opening 13 (shown in FIG. 1) of the housing 14 to a predetermined position shown in FIGS. 2 and 3. The insertion direction of the feed tray is a rearward direction. The feed tray 20 is attached, at the predetermined position, to the housing 14. The feed tray 20 is moved frontward from the predetermined position via a position shown in FIG. 4, and is removed through the opening 13. In other words, the feed tray 20 is advanced to and retracted from the predetermined position, i.e., a sheet feed position, in the housing 14 along the front-rear direction 8, i.e., the feeding direction 17.

When the feed tray 20 is attached, at the predetermined position, to the housing 14 as shown in FIG. 3, the sheet feeder 15 is allowed to feed the recording sheets 12 held on the feed tray 20 to the conveying path 65. On the other hand, when the feed tray 20 is not at the predetermined position and not attached to the printer 11 as shown in FIG. 4, the sheet feeder 15 is not allowed to feed the recording sheets 12 held on the feed tray 20 to the conveying path.

[First Protrusions 75 and Second Protrusions 76]

As shown in FIG. 4, the feed tray 20 comprises first protrusions 75 and second protrusions 76 (an example of a protrusion). The first protrusions 75 and the second protrusions 76 stand upward from a rear end of the sheet holding plate 81. The rear end of the sheet holding plate 81 is a downstream end of the sheet holding plate 81 in the insertion direction of the feed tray 20 into the housing 14 or in the advancing direction of the feed tray to the sheet feed position in the housing.

The first protrusions 75 are slightly shifted leftward and rightward from the center of the sheet holding plate 81 in the left-right direction 9. The second protrusions 76 are positioned at the left and right end portions of the sheet holding plate 81.

When the feed tray 20 is attached, at the predetermined position, to the housing 14, the first protrusions 75 are fitted into recesses 86 (shown in FIGS. 4 and 9) of the guide member 72, as will be described later. As shown in FIG. 3, the first protrusions 75 are positioned rearward of a first inclined surface 67 which is a front surface of the guide member 72. In other word, the first protrusions 75 are positioned downstream of the feed tray 20 in the insertion direction of the feed tray 20.

When the feed tray 20 is attached, at the predetermined position, to the housing 14, the second protrusions 76 are positioned on the right and left of the guide member 72, i.e., positioned outside the guide member 72 in the left-right direction 9. Thus, in this state, the second protrusions 76 do not interfere with the guide member 72. Further, in this state, the second protrusions 76 are positioned rearward of the first inclined surface 67 i.e., downstream of the feed tray 20 in the insertion direction of the feed tray 20.

When the feed tray 20 is detached from the housing 14, the first protrusions 75 and the second protrusions 76 are configured to contact the recording sheets 12 held on the sheet holding plate 81. The first protrusions 75 and the second protrusions 76 stops the recording sheets 12 from dropping from the feed tray 20. When the feed tray 20 is attached, at the predetermined position, to the housing 14, the first protrusions 75 and the second protrusions 76 are positioned rearward of the first inclined surface 67 and are out of contact with the recording sheets 12 held on the sheet holding plate 81.

[Sheet Feeder 15]

Figure 6:
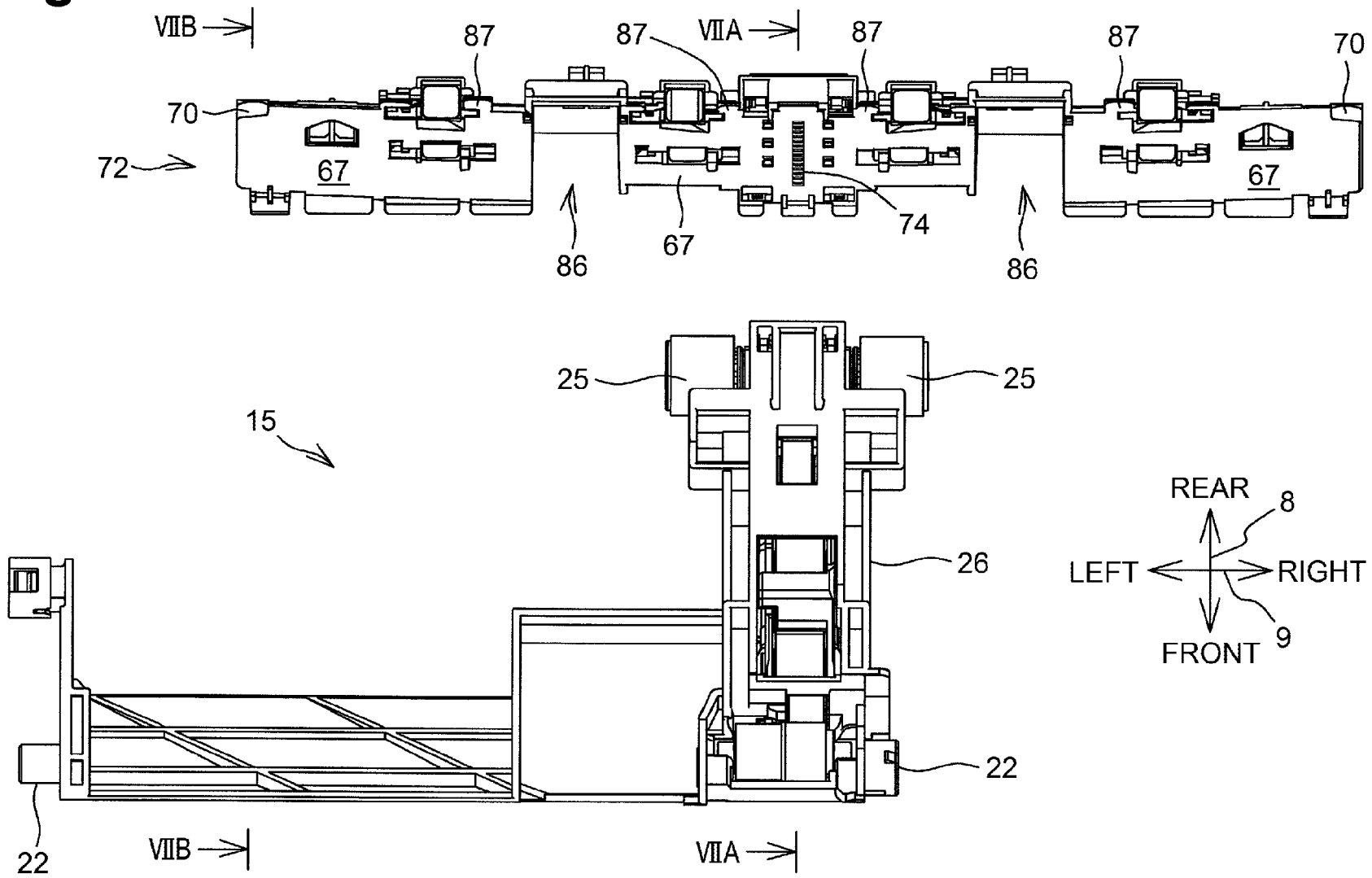
FIG. 6 is a plan view of a sheet feeder and the guide member.

As shown in FIG. 2, the sheet feeder 15 is disposed above the feed tray 20. As shown in FIGS. 6 and 7, the sheet feeder 15 comprises a pair of feed rollers 25, a feed arm 26 (an example of an arm), a drive transmitting mechanism 27, and a shaft 22.

Figure 7A:
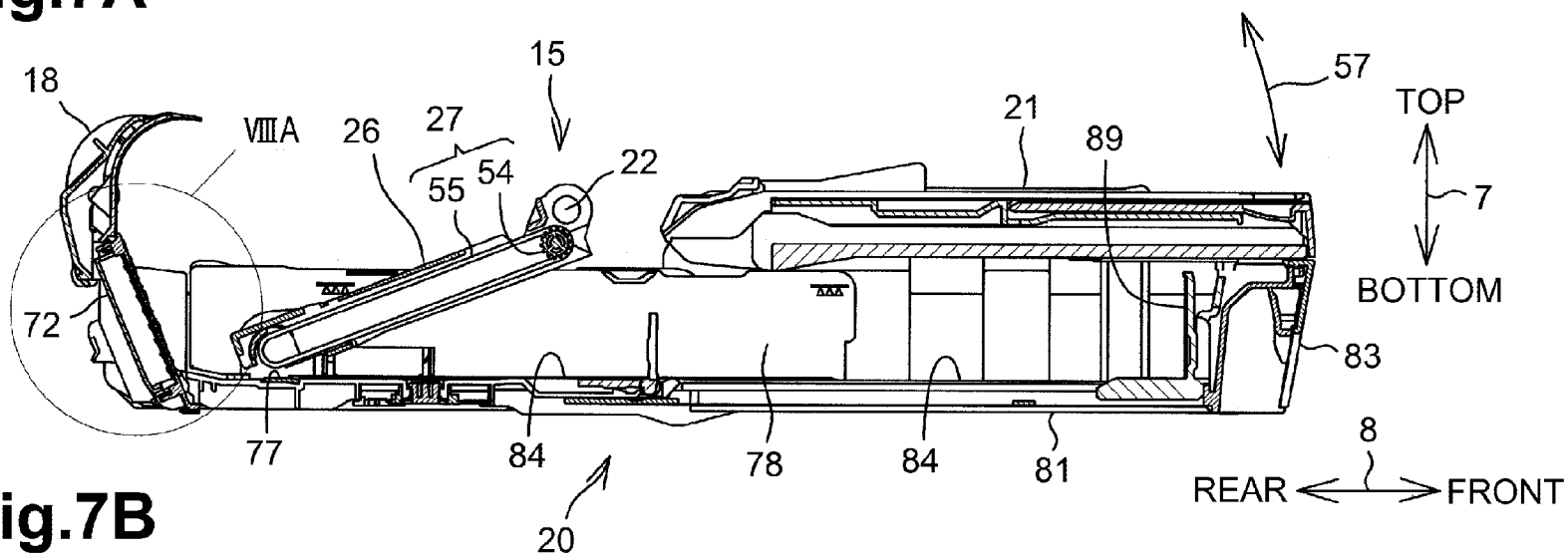
FIG. 7A is a cross-sectional view of FIG. 6 taken along line VIIA-VIIA, showing together the feed tray and the discharge tray.
Figure 7B:
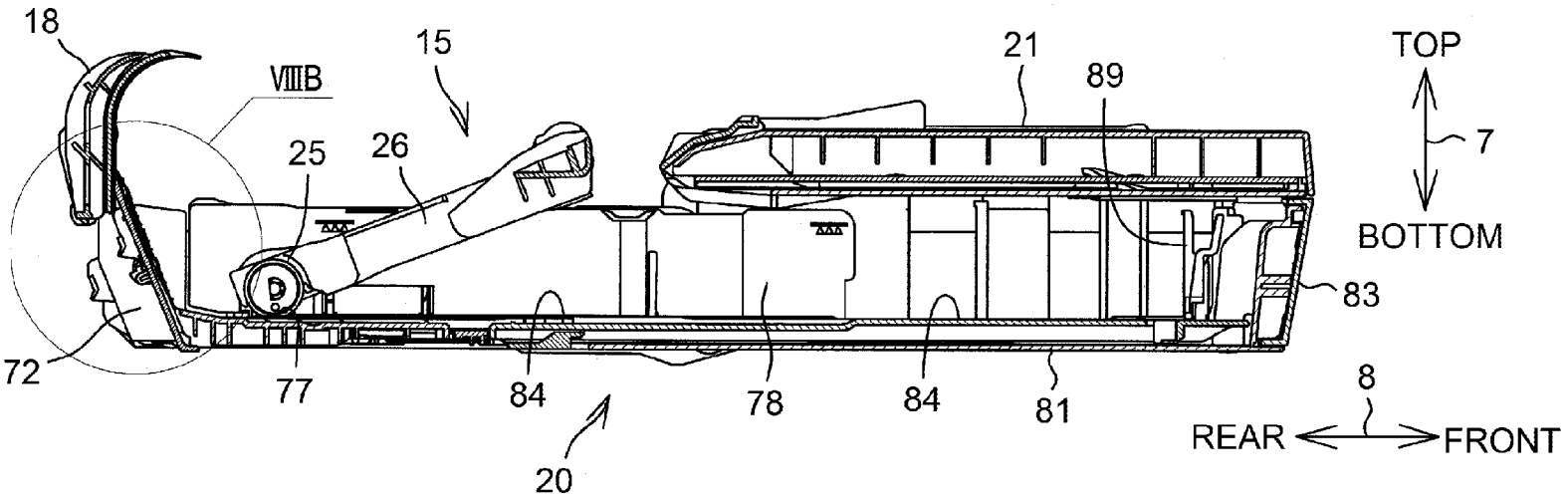
FIG. 7B is a cross-sectional view of FIG. 6 taken along line VIIB-VIIB, showing together the feed tray and the discharge tray.

As shown in FIGS. 2 and 7A, the shaft 22 is disposed at one end of the feed arm 26 such that the feed arm 26 pivots about the shaft 22 in arrowed directions 51, 52. The feed rollers 25 are rotatably supported at the other end of the feed arm 26. The one end of the feed arm 26 is positioned obliquely upward and frontward of the other end. The feed arm 26 is urged in the arrowed direction 52 by its own weight and/or by an urging member, e.g., a spring. This allows the feed rollers 25 to contact an uppermost one of the recording sheets 12 held on the upper surface 84 of the sheet holding plate 81.

As shown in FIG. 6, the feed rollers 25 and the feed arm 26 are disposed opposite to a central portion of the guide member 72 in the left-right direction 9. As shown in FIGS. 3 and 4, when the feed tray 20 is attached, at the predetermined position, to the housing 14, the central portion of the guide member 72 coincides with a central portion of the feed tray 20. In other words, the feed rollers 25 and the feed arm 26 are disposed at the central portion of the fed tray 20 in the left-right direction 9.

The feed rollers 25 rotate by a driving force of the feed motor (not shown) transmitted by the drive transmitting mechanism 27 (shown in FIG. 7). The feed rollers 25 feed the uppermost recording sheet 12 in the feeding direction 17. As shown in FIG. 7A, the drive transmitting mechanism 27 comprises a gear 54, a pulley (not shown), and a belt 55. The gear 54 rotates by receiving the driving force from the feed motor. The pulley rotates integrally with the feed rollers 25. The belt 55 is wound around the gear 54 and the pulley. The belt 55 may be replaced with a plurality of gears (not shown) which are disposed between the gear 54 and the pulley and meshed with each other.

[Guide Member 72]

The guide member 72 is disposed in the housing 14. The guide member 72 may be attached to the housing 14 or may be integrally formed with the housing 14. As shown in FIGS. 2, 3, and 7, the guide member 72 is disposed behind the feed tray 20 attached to the housing 14.

Figure 8A:
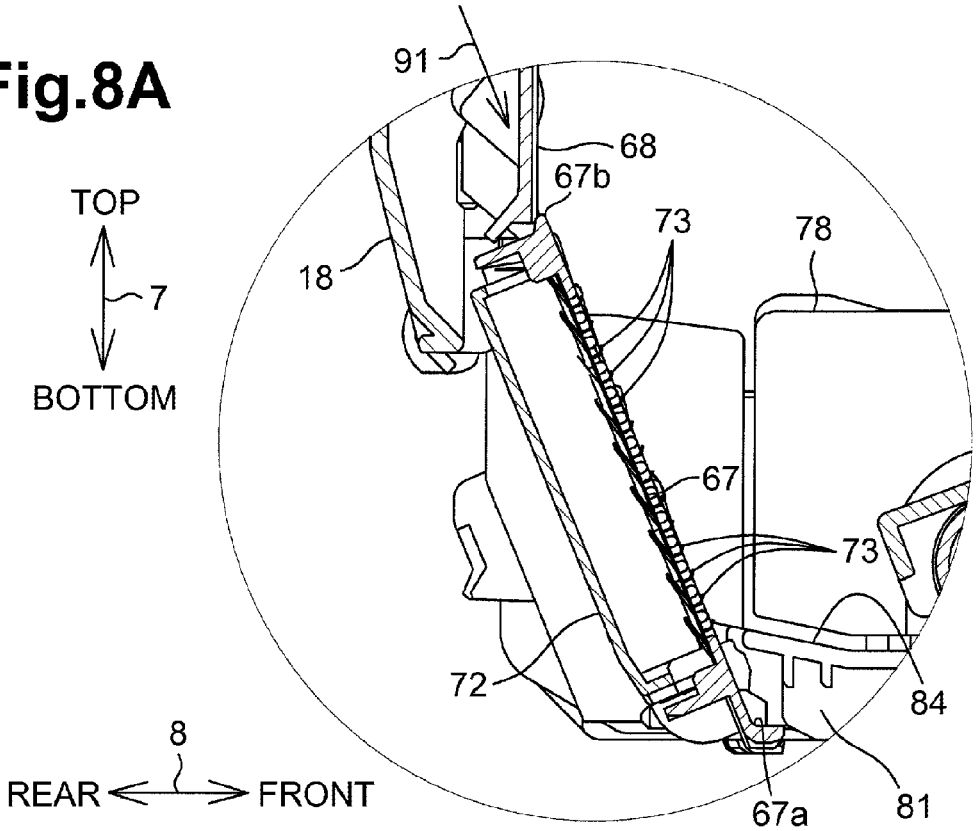
FIG. 8A is a partial enlarged view of FIG. 7A.
Figure 8B:
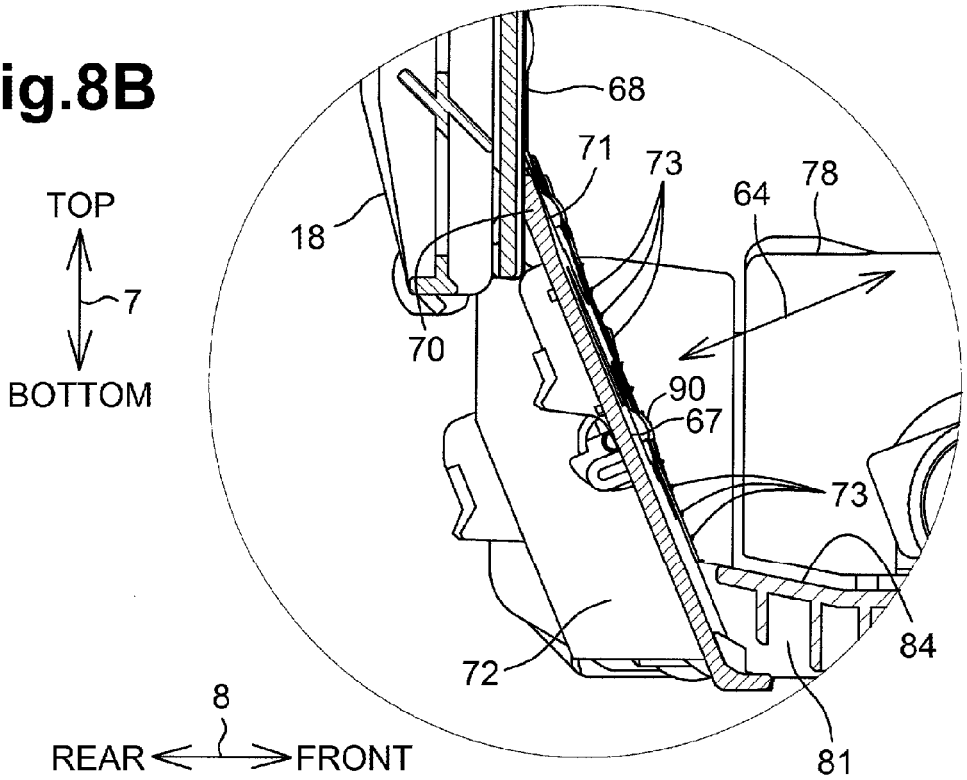
FIG. 8B is a partial enlarged view of FIG. 7B.
Figure 9:
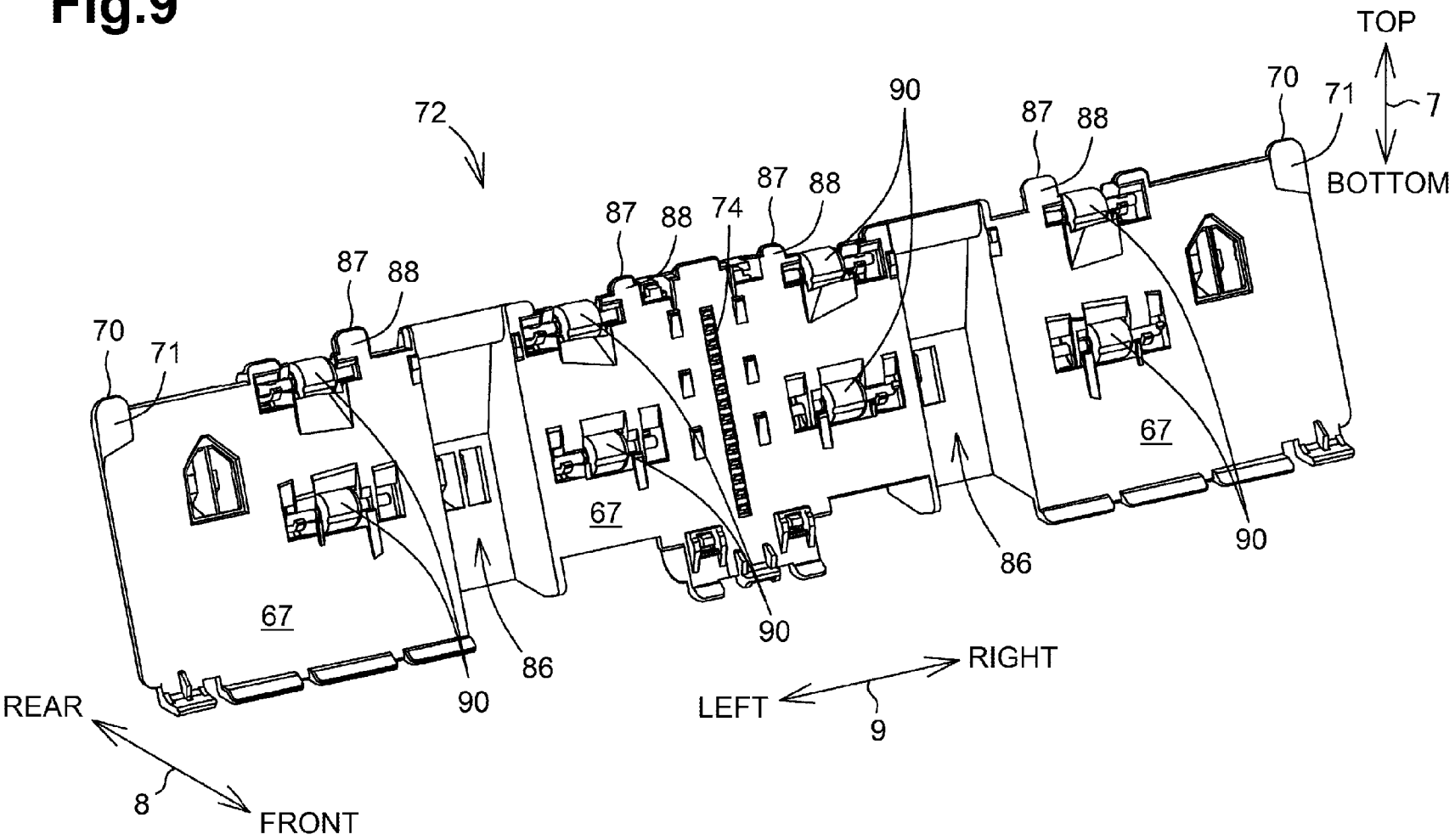
FIG. 9 is a perspective view of the guide member.

As shown in FIGS. 7-9, the guide member 72 has a first inclined surface 67 inclined relative to the upper surface 84 of the sheet holding plate 81 such that a rear end 67*b* (downstream end in the feeding direction 17) of the first inclined surface 67 is positioned above a front end 67*a* (upstream end in the feeding direction 17) of the first inclined surface 67. The first inclined surface 67 is a front surface of the guide member 72. This configuration allows the first inclined surface 67 to contact the recording sheet 12 fed by the sheet feeder 15 in the feeding direction 17 and to guide the recording sheet 12 in the conveying direction 16 along the first inclined surface 67. In other words, the guide member 72 contacts the recording sheet 12 and changes the direction of the recording sheet fed in the feeding direction 17 to an obliquely upward and rearward direction (the conveying direction 16).

The guide member 72 may comprise, in an alternative embodiment, a plurality of ribs spaced from each other in the left-right direction 9. In this case, the first inclined surface 67 is defined by the plurality of ribs. Alternatively, the first inclined surface 67 may be a flat surface, and a plurality of ribs may be formed so as to stand from the flat surface as a part of the first inclined surface 67.

Figure 10:
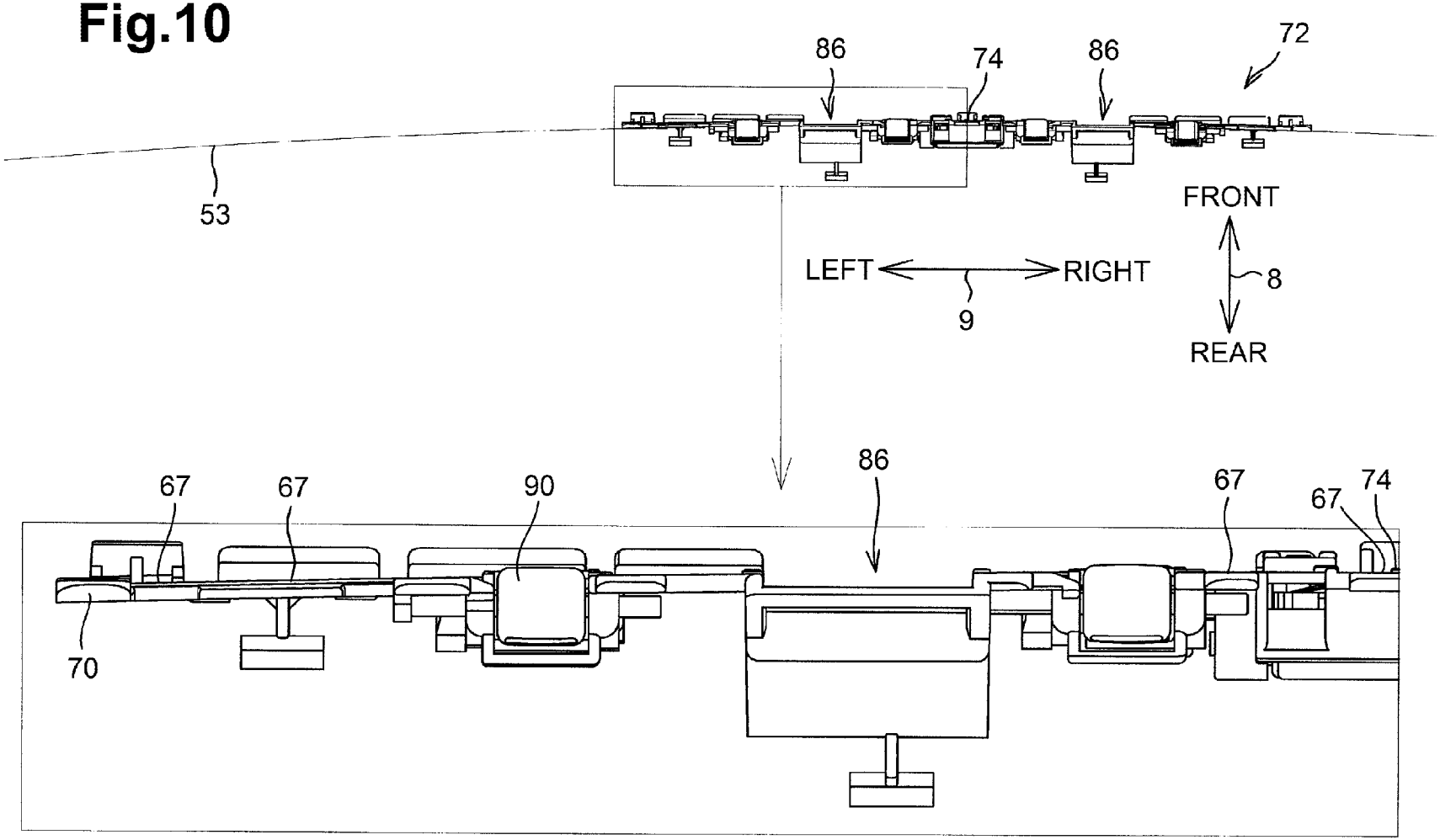
FIG. 10 is a plan view of the guide member as viewed in an arrowed direction 91 in FIG. 8A.

As shown in FIG. 10, the first inclined surface 67 is curved such that a central portion thereof in the left-right direction 9 is positioned frontward of the opposite ends thereof in the left-right direction 9. In other words, the central portion of the first inclined surface 67 is positioned upstream, in the feeding direction 17, of the opposite ends thereof. In FIG. 10, an additional line 53 is drawn to clearly show the curve of the first inclined surface 67.

As shown in FIGS. 3, 4, 8, and 9, a plurality of separation teeth 74 (an example of a separator) are disposed at the central portion of the inclined surface 67 in the left-right direction 9 and are arranged in the top-bottom direction 7 of the first inclined surface 67. The separation teeth 74 protrude further than the first inclined surface 67. As described earlier, the friction pad 77 (shown in FIGS. 3-5) is disposed at the central portion of the sheet holding plate 81 in the left-right direction 9. When the feed tray 20 is attached, at the predetermined position, to the housing 14, the central portion of the sheet holding plate 81 in the left-right direction 9 substantially coincides with the central portion of the guide member 72 in the left-right direction 9. Thus, the separation teeth 74 overlap the friction pad 77 with respect to the left-right direction 9. In other word, the separation teeth 74 overlap the friction pad 77 as viewed from the front of the printer 11.

When two or more recording sheets 12 are fed simultaneously from the feed tray 20, the separation teeth 74 contact the plurality of recording sheets 12 and separate an uppermost one of the recording sheets 12 from the other recording sheets 12. Only the separated uppermost recording sheet 12 is guided along the first inclined surface 67 toward the conveying path 65.

Instead of the separation teeth 74, a pad made of cork may be pasted to the first inclined surface 67 as long as the pad is configured to contact and separate an uppermost one of the recording sheets 12. In this case, the pad is an example of a separator.

As shown in FIG. 9, eight rollers 90 are rotatably attached to the guide member 72. The rollers 90 may be provided more or less than eight. Each of the rollers 90 is disposed in an opening or a recess formed in the first inclined surface 67 such that a part of the periphery of the roller 90 protrudes beyond the first inclined surface 67. Each roller 90 is partially exposed from the first inclined surface 67 and is rotated upon contact with the recording sheet 12. Each roller 90 is disposed, with respect to the left-right direction 9, between the separation teeth 74 and a corresponding one of inclined guide portions 70, which will be described later. As shown in FIG. 8B, each roller 90 is recessed relative to a protruding end 73 of each separation tooth 74 in a perpendicular direction 64 (shown in FIG. 8B) which is a direction perpendicular to the central portion (as an example of a reference position) of the first inclined surface 67 and away from the recording sheets 12 held on the upper surface 84 of the sheet holding plate 81. A third inclined surface 71 of each inclined guide portion 70 is recessed relative to each roller 90 in the perpendicular direction 64.

[Outer Guide Member 18]

As shown in FIGS. 2 and 3, the outer guide member 18 is disposed downstream of the guide member 72 in the conveying direction 16. The outer guide member 18 is disposed obliquely upward and rearward of the guide member 72. A downstream end portion of the outer guide member 18 in the conveying direction 16 is curved so as to extend more frontward than the guide member 72.

As shown in FIGS. 3 and 4, the outer guide member 18 comprises, on a front side thereof, a plurality of ribs 69 extending along the conveying direction 16. The ribs 69 protrude frontward and are spaced from each other in the left-right direction 9. The ribs 69 contact the recording sheet 12 guided obliquely upward and rearward by the guide member 72 and guide the recording sheet 12 substantially vertically upward. The ribs 69 are also curved frontward along the curve of the outer guide member 18. The recording sheet 12 is guided frontward along the ribs 69 in a curved manner and is nipped by the convey roller pair 58. Protruding ends of the ribs 69 partially define a second inclined surface 68 of the outer guide member 18.

An upstream portion of the second inclined surface 68 in the conveying direction 16 or a downstream portion of the guide member 72 in the conveying direction 16 extend substantially along the top-bottom direction 7. Relative to the upper surface 84 of the sheet holding plate 81 of the feed tray 20, the second inclined surface 68 is inclined more steeply than the first inclined surface 67. This allows the second inclined surface 68 to contact the recording sheet 12 guided obliquely upward and rearward and to guide the recording sheet 12 substantially vertically upward. In other words, the outer guide member 18 contacts the recording sheet 12 being fed and changes the conveying direction of the recording sheet 12 from an obliquely upward and rearward direction to a substantially vertically upward direction. In another embodiment, the outer guide member 18 may not comprise a plurality of ribs and a front surface of the outer guide member 18 may guide, as the second inclined surface 68, the recording sheet 12.

Four rollers 92 are rotatably attached to the outer guide member 18. The rollers 92 may be provided more or less than four. Each roller 92 is disposed in an opening formed in the outer guide member 18 such that a part of the periphery of the roller 92 protrudes beyond the second inclined surface 68. Each roller 92 is partially exposed from the second inclined surface 68 and is rotated upon contact with the recording sheet 12.

The outer guide member 18 may be formed only by a plurality of ribs 69. In this case, the plurality of ribs 69 define the second inclined surface 68.

[Inclined Guide Portion 70]

As shown in FIGS. 8B and 9, the guide member 72 comprises, at an upper end portion thereof, inclined guide portions 70 (an example of a first inclined guide portion). The inclined guide portions 70 extend from the upper end portion of the guide member 72 obliquely upward and rearward, i.e., downstream in the conveying direction 16.

Each inclined guide portion 70 has the third inclined surface 71. Similarly to the first inclined surface 67, the third inclined surface 71 is inclined relative to the upper surface 84 of the sheet holding plate 81 of the feed tray 20 such that a rear end (downstream end in the feeding direction 17) of the third inclined surface 71 is positioned above a front end (upstream end in the feeding direction 17) of the third inclined surface 71. The third inclined surface 71 is inclined more steeply than the first inclined surface 67 relative to the upper surface 84 of the sheet holding plate 81. The third inclined surface 71 is a front surface of the inclined guide portion 70. This configuration allows the third inclined surface 71 to contact the recording sheet 12 guided by the guide member 72 obliquely upward and rearward.

The third inclined surface 71 protrudes frontward, i.e., toward the recording sheets 12 on the upper surface 84 of the sheet holding plate 81, from the opposite end portions in the left-right direction 9 of the first inclined surface 67. The third inclined surface 71 is recessed relative to the protruding end 73 of each separation tooth 74 in the perpendicular direction 64 which is a direction perpendicular to the central portion (as an example of a reference position) of the first inclined surface 67 and away from the recording sheets 12 on the upper surface 84.

As shown in FIG. 9, the inclined guide portion 70 is shaped like a tab. However, in an alternative embodiment, the inclined guide portion 70 may be formed into a rib that stands from the upper end portion of the guide member 72 and extends in the conveying direction 16. In this case, an edge of the rib defines the third inclined surface 71.

The inclined guide portions 70 are formed at opposite ends of the guide member 72 in the left-right direction 9 (an example of a width direction) which is perpendicular to the front-rear direction 8 and parallel to the upper surface 84 of the sheet holding plate 81. The inclined guide portions 70 are provided two in total, one at the right end of the guide member 72 and the other at the left end of the guide member 72. The two inclined guide portions 70 are positioned symmetrically relative to the separation teeth 74 in the left-right direction 9.

The inclined guide portions 70 are disposed at opposite end portions of the guide member 72 in the left-right direction 9, which are outer in the left-right direction 9 than the four rollers 92 of the outer guide member 18. The inclined guide portion 70 at the right end of the guide member 72 is positioned rightward of the four rollers 92, and the inclined guide portion 70 at the left end of the guide member 72 is positioned leftward of the four rollers 92. As shown in FIG. 3, the inclined guide portions 70 are disposed at different positions from the ribs 69 of the outer guide member 18 in the left-right direction 9.

Figure 5:
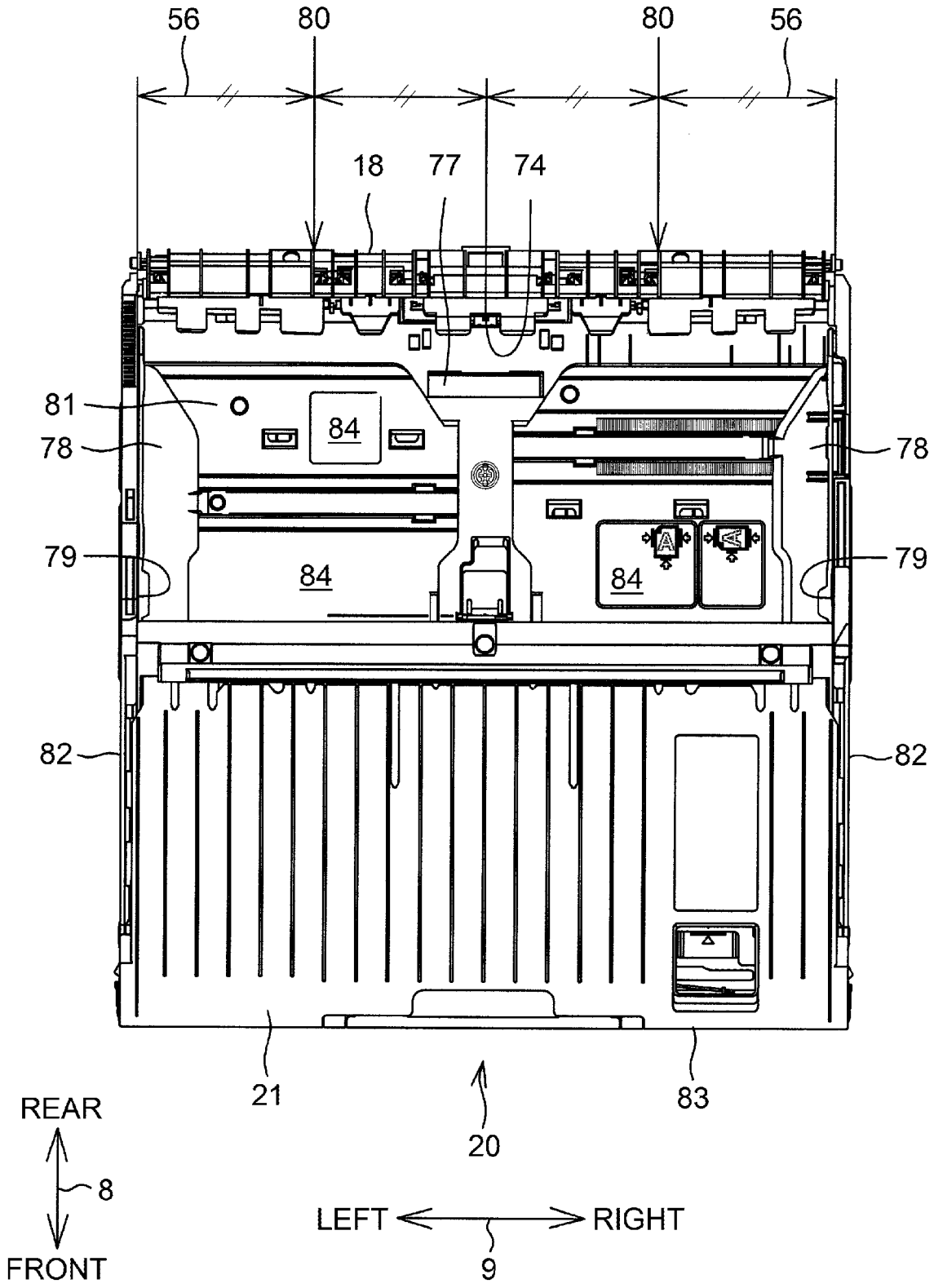
FIG. 5 is a plan view of the feed tray, the discharge tray, the guide member, and the outer guide member.

The inclined guide portions 70 may be positioned other than at opposite ends of the guide member 72 in the left-right direction 9 as along as each inclined guide portion 70 is positioned within a corresponding one of ranges 56 shown in FIG. 5. Each range 56 is defined between one of opposite ends 79 of the upper surface 84 in the left-right direction 9 and a corresponding midpoint 80 which is between the one of opposite ends 79 and the separation teeth 74. Instead of at the opposite ends 79 of the upper surface 84 in the left-right direction 9, the inclined guide portions 70 may be positioned at side faces of the opposite side plates 82 or at side faces of opposite side guides 78 moved to the rightmost and leftmost positions, respectively. The inclined guide portions 70 may be provided more or less than two.

[Second Inclined Guide Portion 87]

As shown in FIG. 9, the guide member 72 comprises, at the upper end portion thereof, second inclined guide portions 87, in addition to the inclined guide portions 70. Similarly to the inclined guide portions 70, the second inclined guide portions 87 extend, from the upper end portion of the guide member 72, obliquely upward and rearward, i.e., downstream in the conveying direction 16. The second inclined guide portions 87 are provided four in total between the inclined guide portions 70 while being spaced from each other in the left-right direction 9. The second inclined guide portions 87 may be provided more or less than four.

Each second inclined guide portion 87 has a fourth inclined surface 88. Similarly to the third inclined surface 71, the fourth inclined surface 88 is inclined relative to the upper surface 84 of the sheet holding plate 81 of the feed tray 20 such that a rear end (downstream end in the feeding direction 17) of the fourth inclined surface 88 is positioned above a front end (upstream end in the feeding direction 17) of the fourth inclined surface 88. As shown in FIG. 9, the inclination of the fourth inclined surface 88 relative to the upper surface 84 is equal to the inclination of the first inclined surface 67 relative to the upper surface 84. However, the inclinations may be different from each other. The fourth inclined surface 88 is a front surface of the second inclined guide portion 87. This configuration allows the fourth inclined surface 88 to contact the recording sheet 12 guided by the guide member 72 obliquely upward and rearward.

Among the four rollers 92, the leftmost roller 92 is interposed between the inclined guide portion 70 at the left end and the leftmost second inclined guide portion 87. The rightmost roller 92 is interposed between the inclined guide portion 70 at the right end and the rightmost second inclined guide portion 87. The number of rollers 92 interposed between one of the inclined guide portions 70 and a corresponding one of the outermost (leftmost and rightmost) second inclined guide portions 87 may be other than one. For example, some of the rollers 92 may be interposed between one of the inclined guide portions 70 and a corresponding one of the outermost second inclined guide portions 87, and the rest of the rollers 92 may be interposed between the other inclined guide portion 70 and the other outermost second inclined guide portion 87.

[Feeding Operation]

Described, in detail, below is a sheet feeding operation when a relatively large stack of recording sheets 12 is held on the feed tray 20 such that uppermost two of the separation teeth 74 are above the upper end of the recording sheets 12.

The feed rollers 25 move two or more uppermost recording sheets 12 from the stack of recording sheets 12 in the feeding direction 17. When the leading edges of the two or more uppermost recording sheets 12 reach the separation teeth 74, the separation teeth 74 separate the uppermost recording sheet 12 from the other recording sheets. The leading edge of the uppermost recording sheet 12 is moved in contact with the first inclined surface 67. A leading edge portion of the uppermost recording sheet 12 changes in shape from a shape along the feeding direction 17 to a shape along the first inclined surface 67. The leading edge portion of the recording sheet 12, other than its opposite end portions in the left-right direction 9, is maintained in a shape along the first inclined surface 67 even after the leading edge portion passes the first inclined surface 67.

Force of the feed rollers 25 is harder to be transmitted to the opposite end portions in the left-right direction 9 of the recording sheet 12 than to a central portion of the recording sheet 12 in the left-right direction 9. Therefore, without the inclined guide portions 70, the opposite end portions in the left-right direction 9 of the leading edge portion of the recording sheet 12 may return to a shape along the feeding direction 17 from a shape along the first inclined surface 67 and may droop when the leading edge portion of the recording sheet 12 has passed the first inclined surface 67.

In this embodiment, however, the inclined guide portions 70 are provided to the guide member 72. The opposite end portions in the left-right direction 9 of the leading edge portion of the recording sheet 12, upon reaching the inclined guide portions 70 after passing the first inclined surface 67, contact the third inclined surfaces 71 of the inclined guide portions 70, respectively. As described earlier, the third inclined surface 71 protrudes from the opposite end portions in the left-right direction 9 of the first inclined surface 67 and is steeper than the first inclined surface 67. Thus, the opposite end portions in the left-right direction 9 of the leading edge portion of the recording sheet 12 change in shape from a shape along the first inclined surface 67 to a shape along the third inclined surface 71. Consequently, the opposite end portions of the leading edge portion of the recording sheet 12 are prevented from drooping.

As the recording sheet 12 is conveyed further, the leading edge of the recording sheet 12 leaves the first inclined surface 67 and the third inclined surface 71 and contacts the second inclined surface 68 (ribs 69) of the outer guide member 18. The leading edge portion of the recording sheet 12 changes in shape from shapes along the first inclined surface 67 and along the third inclined surface 71 to a shape directed more vertically upward.

When a relatively small stack of recording sheets 12 is held on the feed tray 20, the recording sheet 12 is fed while its leading edge is kept in contact with the first inclined surface 67 for a relatively long duration. This makes the leading edge portion of the recording sheet 12 less likely to return from a shape along the first inclined surface 67 to a shape along the feeding direction 17. In this case, when the recording sheet 12 is fed, the opposite end portions in the left-right direction 9 of the leading edge portion of the recording sheet 12 follow the first inclined surface 67 and then the third inclined surface 71.

Effects in Embodiment

According to the above-described embodiment, the inclined guide portions 70 are apart from the separation teeth 74 in the left-right direction 9 and extend downstream in the conveying direction 16 from the upper end portion of the guide member 72. When the downstream edge of the recording sheet 12 in the conveying direction 16 passes the upper end portion of the guide member 72, portions of the downstream edge of the recording sheet 12, which are apart from the separation teeth 74 in the left-right direction 9, are supported by the third inclined surfaces 71, respectively. This prevents or reduces drooping of the portions of the recording sheet 12 which are apart from the separation teeth 74. Accordingly, the recording sheet 12 can be fed smoothly while the conveying direction of the recording sheet 12 is changed to a more vertically upward direction, regardless of the amount of the stack of recording sheets 12.

According to the above-described embodiment, the second protrusions 76 are configured to contact the edges of the recording sheets 12 held on the upper surface 84 when the feed tray 20 is detached from the housing 14. The second protrusions 76 prevent the recording sheets 12 from dropping off the feed tray 20. When the feed tray 20 is attached, at the predetermined position, to the housing 14, the second protrusions 76 are positioned outside of the guide member 72 in the left-right direction 9 and rearward of the first inclined surface 67. Thus, the recording sheet 12 supported by the first inclined surface 67 and the second protrusions 76 is curved. When the downstream edge of the recording sheet 12 in the conveying direction 16 passes the upper end portion of the guide member 76, portions of the downstream edge of recording sheet 12 which are supported by the second protrusions 76 are prone to drooping below a portion of the downstream edge of the recording sheet 12 supported by the first inclined surface 67. However, the third inclined surfaces 71 support the recording sheet 12, thereby to prevent or reduce such dropping.

According to the above-described embodiment, the inclined guide portions 70 are formed at the opposite ends of the guide member 72 in the left-right direction 9. The opposite ends of the guide member 72 are apart from the separation teeth 74 in the left-right direction 9. The third inclined surfaces 71 support the recording sheet 12 fed by the sheet feeder 15, thereby to prevent or reduce drooping of side edges of the recording sheet 12.

According to the above-identified embodiment, because the outer guide member 18 comprises the ribs 69, the recording sheet 12 contacts a reduced area of the second inclined surface 68, thereby to ensure smooth guiding of the recording sheets 12 by the out guide member 18. The ribs 69 protrude toward the guide member 72, i.e., frontward while the inclined guide portions 70 protrude toward the outer guide member 18. The ribs 69 are formed at different positions from the inclined guide portions 70 in the left-right direction 9 so as to reduce a space between the ribs 69 and the inclined guide portions 70. This configuration reduces sheet jams between the guide member 72 and the outer guide member 18 and downsizes the multi-function device 10 which comprises the feeding device.

According to the above-described embodiment, the separation teeth 74, which are configured to readily contact the recording sheets 12, prevent or reduce simultaneous feeding of two or more recording sheets 12 stacked on the upper surface 84. The recording sheet 12 supported on the first inclined surface 67 is curved about the separation teeth positioned at the center in the left-right direction 9. When the recording sheet 12 passes the guide member 72, portions of the recording sheet 12 which are apart from the separation teeth 74 in the left-right direction 9 are prone to drooping. However, the third inclined surfaces 71 support the recording sheet 12, thereby to prevent or reduce such drooping.

According to the above-described embodiment, the rollers 92 allow the recording sheet 12 to be guided smoothly along the outer guide member 18. With respect to the left-right direction 9, one roller 92 is interposed between the left inclined guide portion 70 and the leftmost second inclined guide portion 87, and another roller 92 is interposed between the right inclined guide portion 70 and the rightmost second inclined guide portion 87. This configuration prevents the leading edge of the recording sheet 12 from drooping at positions corresponding to the rollers 92 and being caught at the rollers 92.

Further, according to the above-described embodiment, the pressing force, i.e., the conveying force of the feed rollers 25 to the recording sheets 12 decreases as the stack of recording sheets 12 on the feed tray 20 increases. However, even when the conveying force of the feed rollers 25 to the recording sheets 12 is relatively small, the third inclined surfaces 71 support the recording sheet 12 so as to ensure smooth conveyance of the recording sheet 12.

Further, according to the above-described embodiment, the conveying force of the feed rollers 25 to the recording sheets 12 increases as the stack of recording sheets 12 on the upper surface 84 decreases. The friction pad 77, which contacts a lowermost recording sheet 12 of the stack, prevents or reduces simultaneous feeding of two or more recording sheets. The friction pad 77, which protrudes further than the upper surface 84, curves the recording sheets 12 supported on the upper surface 84 about the contact portion between the lowermost recording sheet 12 and the upper surface 84. Thus, when the downstream edge of the recording sheet 12 in the conveying direction passes the upper end portion of the guide member 72, portions of the recording sheet 12 which are apart from the separation teeth 74 in the left-right direction 9 are prone to drooping. However, the third inclined surfaces 71 support the recording sheet 12, thereby to prevent or reduce such drooping.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet feeding device comprising:

a tray comprising a supporting surface configured to support a stack of sheets thereon, the supporting surface having opposite ends in a width direction, the width direction being perpendicular to a feeding direction and parallel to the supporting surface;

a sheet feeder configured to feed a sheet uppermost in the stack in the feeding direction;

a first guide member disposed downstream of the tray in the feeding direction, the first guide member comprising a first inclined surface configured to contact the sheet fed by the sheet feeder and guide the sheet in a conveying direction, the first inclined surface being inclined relative to the supporting surface such that a downstream end of the first inclined surface is above an upstream end thereof in the feeding direction;

a separator protruding relative to the first inclined surface and configured to separate the sheet fed by the sheet feeder from other lower sheets;

a second guide member disposed downstream of the first guide member in the conveying direction, the second guide member comprising a second inclined surface configured to contact the sheet fed by the sheet feeder, and the second inclined surface being inclined more steeply than the first inclined surface relative to the supporting surface; and a first inclined guide portion disposed at an upper end portion of the first guide member and extending downstream in the conveying direction beyond an upper end of the first guide member, the first inclined guide portion comprising a third inclined surface configured to contact the sheet fed by the sheet feeder, the third inclined surface being inclined more steeply than the first inclined surface relative to the supporting surface, and the first inclined guide portion being closer to a corresponding one of the opposite ends of the supporting surface than to a center of the first guide member in the width direction and spaced apart, in the width direction, from the corresponding one of the opposite ends of the supporting surface.

2. The sheet feeding device according to claim 1, wherein the separator is disposed at a reference position of the first guide member, and the third inclined surface of the first inclined guide portion is recessed relative to a protruding end of the separator in a perpendicular direction, the perpendicular direction being a direction perpendicular to the first inclined surface at the reference position and away from the stack of sheets to be held on the supporting surface.

3. The sheet feeding device according to claim 2, wherein the first guide member comprises a roller partially exposed from the first inclined surface and configured to rotate upon contact with the sheet fed by the sheet feeder, and the third inclined surface is recessed relative to the roller in the perpendicular direction.

4. The sheet feeding device according to claim 1, further comprising a housing, wherein the first guide member is disposed in the housing, wherein the tray is movable in the housing from a retracted position to an advanced position in an advancing direction relative to the first guide member, and the tray comprises a protrusion which protrudes upward from a downstream end of the supporting surface in the advancing direction, and wherein when the tray is in the advanced position in the housing, the protrusion is positioned between the one of opposite ends of the supporting surface in the width direction and the first guide member and is positioned downstream of the first inclined surface in the advancing direction.

5. The sheet feeding device according to claim 1, wherein the first inclined guide portion is formed at an end of the first guide member in the width direction.

6. The sheet feeding device according to claim 1, wherein the second guide member extends in the conveying direction and comprises a plurality of ribs which define at least a part of the second inclined surface, each of the plurality of ribs being at different positions in the width direction from the first inclined guide portion.

7. The sheet feeding device according to claim 1, wherein the first inclined surface of the first guide member is curved such that a central portion of the first inclined surface in the width direction is positioned upstream, in the feeding direction, of opposite ends thereof in the width direction, and wherein the separator is positioned at the central portion of the first inclined surface in the width direction.

8. The sheet feeding device according to claim 1, further comprising:

a roller partially exposed from the second inclined surface of the second guide member and configured to rotate upon contact with the sheet fed by the sheet feeder; and a second inclined guide portion extending downstream in the conveying direction from the upper end portion of the first guide member, the second inclined guide portion comprising a fourth inclined surface configured to contact the sheet fed by the sheet feeder, wherein the roller is positioned between the first inclined guide portion and the second inclined guide portion in the width direction.

9. The sheet feeding device according to claim 1, wherein the sheet feeder comprises:

an arm disposed above the tray, the arm being configured to pivot about one end of the arm; and a feed roller rotatably disposed at the other end of the arm, the feed roller being configured to contact the stack of sheets on the supporting surface.

10. The sheet feeding device according to claim 9, wherein the tray comprises a friction pad disposed on the supporting surface at a position to be contacted by the feed roller of the sheet feeder, the friction pad protruding relative to the supporting surface and having a higher friction coefficient than the supporting surface, and wherein the separator overlaps the friction pad with respect to the width direction.

11. A sheet feeding device comprising:

a tray comprising a supporting surface configured to support a stack of sheets thereon, the supporting surface having opposite ends in a width direction, the width direction being perpendicular to a feeding direction and parallel to the supporting surface;

a sheet feeder configured to feed a sheet uppermost in the stack in the feeding direction;

a first guide member disposed downstream of the tray in the feeding direction, the first guide member comprising a first inclined surface configured to contact the sheet fed by the sheet feeder and guide the sheet in a conveying direction, the first inclined surface being inclined relative to the supporting surface;

a separator protruding relative to the first inclined surface and configured to separate the sheet fed by the sheet feeder from other lower sheets;

a second guide member disposed downstream of the first guide member in the conveying direction, the second guide member comprising a second inclined surface configured to contact the sheet fed by the sheet feeder, and the second inclined surface being inclined more steeply than the first inclined surface relative to the supporting surface; and a pair of inclined guide portions disposed at symmetrical positions of an upper end portion of the first guide member relative to the separator, each inclined guide portion extending downward in the conveying direction beyond an upper end of the first guide member comprising a third inclined surface configured to contact the sheet fed by the sheet feeder, the third inclined surface being inclined more steeply than the first inclined surface relative to the supporting surface, and each inclined guide portion being closer, in the width direction, to a corresponding one of the opposite ends of the supporting surface than to the separator.

12. The sheet feeding device according to claim 11, wherein each of the inclined guide portions is positioned at a corresponding one of opposite ends of the first guide member in the width direction.

13. The sheet feeding device according to claim 11, wherein the separator is disposed at a central portion of the first inclined surface in the width direction, the third inclined surface of each of the inclined guide portions being recessed relative to a protruding end of the separator in a perpendicular direction, the perpendicular direction being a direction perpendicular to the central portion of the first inclined surface and away from the stack of sheets to be held on the supporting surface.

14. The sheet feeding device according to claim 13, wherein the first guide member comprises a roller partially exposed from the first inclined surface and configured to rotate upon contact with the sheet fed by the sheet feeder, and the third inclined surface is recessed relative to the roller in the perpendicular direction.

15. An image recording apparatus comprising:

a recording unit configured to record an image on a sheet; and a sheet feeding device configured to feed the sheet to the recording unit; the sheet feeding device comprising:

a tray comprising a supporting surface configured to support a stack of sheets thereon, the supporting surface having opposite ends in a width direction, the width direction being perpendicular to a feeding direction and parallel to the supporting surface;

a sheet feeder configured to feed the sheet uppermost in the stack in the feeding direction;

a first guide member disposed downstream of the tray in the feeding direction, the first guide member comprising a first inclined surface configured to contact the sheet fed by the sheet feeder and guide the sheet in a conveying direction, the first inclined surface being inclined relative to the supporting surface such that a downstream end thereof is above an upstream end thereof in the feeding direction;

a separator protruding relative to the first inclined surface, the separator being configured to separate the sheet fed by the sheet feeder from other lower sheets;

a second guide member disposed downstream of the first guide member in the conveying direction, the second guide member comprising a second inclined surface configured to contact the sheet fed by the sheet feeder, and the second inclined surface being inclined more steeply than the first inclined surface relative the supporting surface; and an inclined guide portion disposed at an upper end portion of the first guide member and extending downstream in the conveying direction beyond an upper end of the first guide member, the inclined guide portion comprising a third inclined surface configured to contact the sheet fed by the sheet feeder, and the third inclined surface being inclined more steeply than the first inclined surface relative to the supporting surface, and the inclined guide portion being closer to a corresponding one of opposite ends of the supporting surface than to a center of the first guide member in a width direction and spaced apart, in a width direction, from the corresponding one of the opposite ends of the supporting surface.

* * * * *